United States Patent [19]

McDonald, II

[11] Patent Number: 4,550,710

[45] Date of Patent: Nov. 5, 1985

[54] MODULAR WATER HEATER CONNECTION APPARATUS AND METHOD FOR FABRICATING SAME

[76] Inventor: William E. McDonald, II, 1560 Cloverdale, Highland Park, Ill. 60035

[21] Appl. No.: 416,951

[22] Filed: Sep. 13, 1982

[51] Int. Cl.[4] ..... F24H 1/00

[52] U.S. Cl. ..... 126/362; 137/315

[58] Field of Search ..... 237/19, 56, 61, 8 R, 237/8 C; 126/362; 122/17; 137/266, 269, 271, 315, 320

[56] References Cited

U.S. PATENT DOCUMENTS 1,093,195 4/1914 Lockhart ..... 237/61

3,461,854 8/1969 Toni et al. ..... 126/362

*Primary Examiner*—Henry Bennett

*Attorney, Agent, or Firm*—Dick and Harris

[57] ABSTRACT

A modular water heater connection apparatus for integrally joining the cold water input and hot water output bungs of two conventional hot water heaters arranged in tandem. Low-profile hot and cold water connection circuitry cooperates to connect two substantially smaller water heaters in parallel to preclude the need for replacing one of the smaller ones with a substantially large and expensive water heating unit. The apparatus includes a structural configuration for isolating the position of the hot water connection circuitry to preclude inadvertent contact therewith.

6 Claims, 3 Drawing Figures

MODULAR WATER HEATER CONNECTION APPARATUS AND METHOD FOR FABRICATING SAME

BACKGROUND OF THE INVENTION

The present invention relates, in general, to hot water heater plumbing circuitry and in particular to a modular water heater connection apparatus for integrally joining two conventional water heaters, toward operation thereof as an integrated unit.

Presently, when the owner of a hot water heater requires additional hot water heating capacity the most conventional way of solving this problem is to replace the smaller capacity, older, water heating unit with a substantially expensive new large capacity water heater. This is unfortunately true with regard to water heaters where prices increase substantially greater than the relative water heating capacity increases. It is of substantial benefit to a water heater user to be able to increase water heating capacity not by replacing and junking his older, still operating water heater but by merely purchasing and installing a smaller water heater or like size and brand next to the older existing unit and combining the two into a tandem, parallel operation. While jerry-rigged interconnection between water heater appliances have been done in the past, the substantial time involved with an "on-site" installation, the problems arising out of unequal flow between the connected water heaters wherein one water heater is overtaxed compared to the other, the difficulty in available work space and intereference with ductwork and flues, and the ever-present safety problems presented by extended unisolated hot water piping have often made such installations, to date, impractical.

It is thus an object of the present invention to provide a modular water heater connection apparatus capable of expanding the water heater capacity of a single water heating unit through the tandem "parallel" arrangement of another one of like construction and size next to it, through an inexpensive apparatus which is capable of facilitating the connecting operation to in turn save expensive plumbing costs. Accordingly, it is such an object of the invention to preclude the need for purchasing a larger capacity water heater and discarding an otherwise operable water heating unit.

It is additionally an object of the present invention to provide such a water heater connection apparatus which is low-profile in structure to accommodate simultaneously the isolation of hot water pipes while avoiding interference with flues and ductwork in a modular design.

It is a further object of the present invention to provide such an installation apparatus which is capable of connecting like heaters in like sizes while at the same time permitting a balanced flow of hot and cold water into the integrated hot water system and out of the hot water system respectively so as to preclude the uneven strain on any one of the two modularly connected devices.

Yet another object of the invention is to provide such an apparatus which safely connects the two water heaters into a closed modular system.

A related object of the invention is to provide such a connection apparatus which may be prefabricated in volumes so as to efficiently reduce the substantial time and costs involved with on-site fabrication, one which may be so prefabricated for a number of known water heater makes, models and capacities. In line with this object is the additional object of such a prefabricated installation device which permits the application of conventional pipe fitting and formation techniques including sweating, fluxing and burnishing at an off-site location so as to reap the economies afforded thereby.

These and other objects of the invention will become apparent in light of the present specification and drawings.

SUMMARY OF THE INVENTION

The present invention comprises a modular water heater connection device for integrally joining the cold water input and hot water output bungs of two conventional water heaters into a parallel tandem system.

Low-profile cold water connection means include a single cold water circuit input for directing cold water from the source of the cold water to the water heaters through a plurality of cold water heater inputs operably connected at their first ends to the circuit input means and at their second opposite ends to each of the respective cold water input bungs. Low-profile hot water connection means are utilized which include a single hot water circuit output fitting for directing the water heated by the water heaters to a single output destination as well as a plurality of hot water heater output means connected at their first ends to the circuit output fitting and at their second opposite ends to each of the respective hot water output bungs emanating from the hot water heaters to transfer the heated water from each of the water heaters to that single output destination. Flow stoppage means are interpositioned within one or more of the hot and cold water connection means. Additionally, the cold and hot water connection means are connected to their respective bungs by bung connection means and to the respective circuit input and output means by circuit attachment means.

The apparatus further includes hot water segregation means for isolating the position of the hot water connection means to preclude inadvertent burning of a user in the vicinity of the water heaters as well as water flow balancing means for equalizing the flows of hot and cold water into and out of the tandem water heaters through the respective connection circuits.

In this embodiment, the low-profile cold and hot water connection means comprises a water flow conduit arrangement emanating a substantially short distance up vertically from the eater heaters before bending into a position substantially horizontal in nature. Each of the plurality of cold water heater input means and hot water flow conduit emanating from the respective bungs in a substantially vertical position which, as mentioned, then bend into the respective horizontal positions which are substantially parallel to the top planar surfaces of the water heater. The cold water circuit input means and hot water circuit output means rise substantially vertically from respective ones of the cold water heater input and hot water heater output means already positioned into their substantially horizontal configurations.

Preferably, the plurality of cold water heater input means comprises two cold water heater input conduits joined to the circuit input means by a T-shaped input coupling member and the plurality of hot water heater output means comprises, similarly, two heater output conduits joined to the circuit output means by a substantially T-shaped output coupling member.

The one or more flow stoppage means comprise valving members with at least one of these valving members being operably connected into each of the plurality of cold water heater inputs and at least one of the valving members being operably connected into each of the plurality of hot water output members therebetween for facilitating the servicing of the hot water heaters.

In the preferred embodiment of the invention, the positions of the hot water bungs and heater tubing associated therewith are pre-positioned so as to be substantially adjacent along the innermost edges of the tandem water heaters. The respective hot water bungs thus assume positions substantially closer to one another than the substantially larger distances positioned between the respective cold water bungs on each of the water heaters. Through such an arrangement, the hot water connection means can be segregated and isolated with the hot water bungs operably connected into the hot water heater output means where these output means initially assume their substantially short, vertical position. The heater output means then bend into their horizontal positions in a rearward directionn from the exposed fronts of the tandem water heaters and then bend again inwardly toward one another to operably meet in the horizontal plane and connect into the respective opposite ends of the hot water circuit output element. The cold water input means similarly assumes an intially vertical configuration bending into their substantially horizontal positions in a direction forwardly toward the exposed fronts of said tandem water heaters bending, again, toward one another to operably meet in the horizontal plane and connect into the respective opposite ends of the cold water circuit input element. Through such a configuration, the cold water connection means serves as a guardrail for the rearwardly isolated hot water connection means.

The water flow balancing means for equalizing the flow of cold water and hot water within respective ones of the cold water connection and hot water connection means comprises cold water circuit input means equidistantly positioned between each of the plurality of cold water heater input means and hot water output means being equidistantly positioned between each of the plurality of hot water heater output means. This equidistant positioning of the cold and hot water circuit input and output means respectively serves to equalize the balance the flow through each of the heater input and output means, providing the cross sections of conduit are equivalent.

The present invention further comprises a method for integrally joining two conventional water heaters through which the heaters' cold water input bungs and hot water output bungs are joined into a tandem, parallel water heater system. This method comprises the steps of pre-positioning the hot water bungs so as to be substantially diametrically adjacent to one another, operably connecting equally sized hot water output conduits to each of the hot water bungs in a position initially emanating upwardly from the heaters then rearwardly from the exposed fronts of the heaters and inwardly toward one another for operable connection into the opposite ends of a hot water circuit fitting, with an upwardly directed hot water release port. The method further comprises the operable connection of equally sized cold water input conduits to each of the cold water bungs in a position initially emanating upwardly from the hot water heaters, then forwardly toward the exposed fronts of the heaters and then inwardly toward one another for operable connection into the opposite ends of a cold water circuit fitting having an upwardly directed cold water entry port. Valving means are then positioned within each of the hot water output conduits and each of the cold water input conduits.

Preferably this method of connecting the tandem hot water heaters into a parallel system includes the prefabrication of the hot water and cold water connection system through which conduit tubing is pre-cut into desired respective equidistant lengths which are then integrated through dielectric unions, 90° ells, T-fittings and valves into said respective conduit paths so as to form same. The unions, ells, fittings and valve ends are refluxed and sweated into the respective conduit paths and these conduit paths are then burnished prior to the pressure testing of the conduit paths so as to make capable the subsequent integrated installation of the entire prefabricated conduit system to the respective cold water input bungs and hot water output bungs on the existing conventional hot water heaters.

DETAILED DESCRIPTION OF THE DRAWINGS

Figure 1:
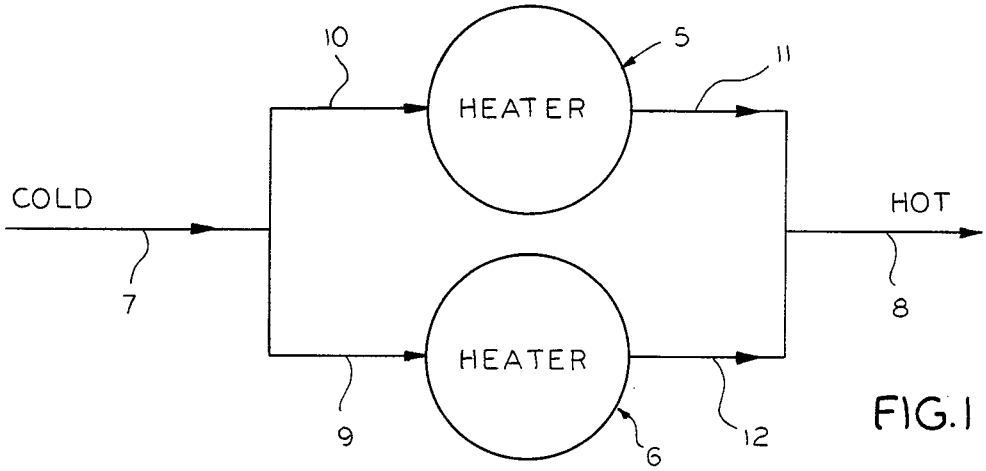
FIG. 1 is a top plan schematic view of apparatus arrangement particularly showing "parallel" integration of two tandem water heaters by way of the present apparatus.

While this invention is susceptible of embodiment in many different formms, there is shown in the drawings and will herein be described in detail, one specific embodiment, with the understanding that the present disclosure is to be considered as an exemplification of the principles of the invention and is not intended to limit the invention to the embodiments illustrated.

FIG. 1 of the drawings shows, by way of schematic illustration, the parallel interconnection between two water heaters arranged in tandem so as to make capable reliance upon the hot water capacities of each of two smaller water heaters without the need for replacing an intial smaller water heater with a much more expensive large water heater. Cold water is shown entering the system through single source circuit 7 at which time it branches off through cold water heater input means 9 and 10 which are subsequently attached at the respective cold water bungs on water heaters 6 and 5. After water is heated within the water heaters in a conventional manner, hot water heater output circuits 11 and 12 serve to direct and to channel the heated watter to a single destination circuit 8 for connection into, for example, a building's hot water plumbing path.

Figure 2:
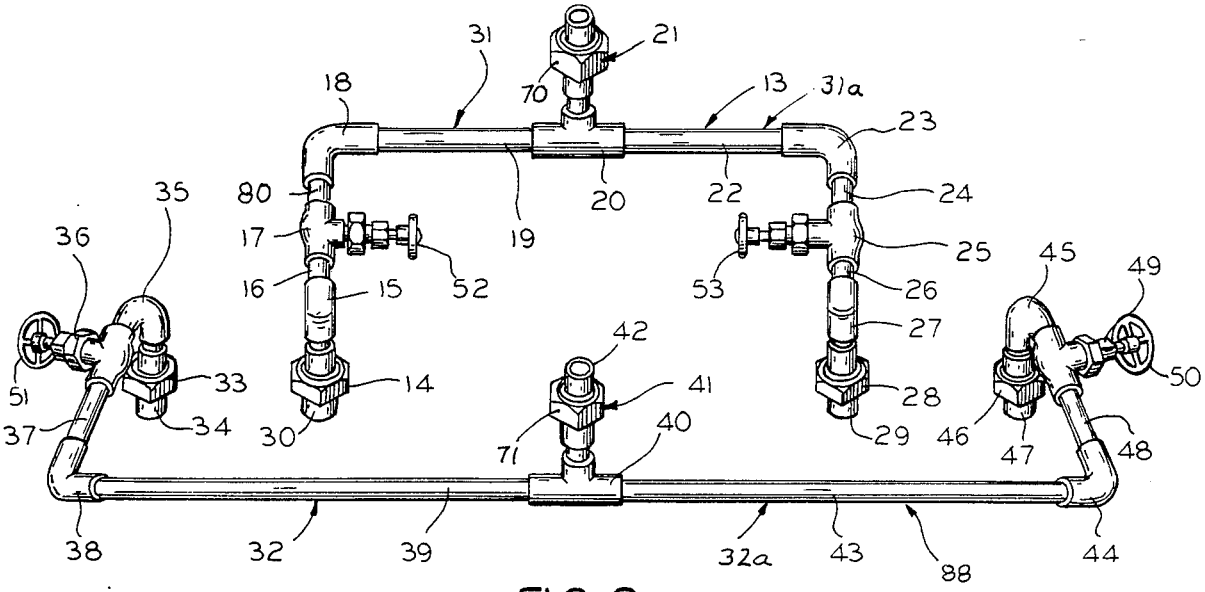
FIG. 2 is a front perspective view taken from a top position showing particularly the hot and cold water connection means utilized by the apparatus for said tandem parallel connection of two hot water heaters.

The actual apparatus utilized to accommodate the parallel connection of the two tandem heaters 5 and 6 for subsequent balanced flow into a single output source and conversely channel cold water emanating from a single cold water source into the two heaters, is shown in FIG. 2. Hot water connection means 13 is shown being capable of attachment to the pre-positioned adjacent hot water bungs 30 and 29 on the respective tandem water heaters being connected. Hot water heater circuits 31 and 31*a* serve to draw the hot water from each of the tandem water heaters to direct it to hot water output circuit means 21 which serves as a single emanating output source for the combined hot water product of the two hot water heaters. The hot water circuit path 13 is made up of a series of circuit tubes such as conduits 19, 22, 16, 26, 24 and 80 which are assembled into respective equidistant paths between tap 29 and T-fitting 20 and between bung 30 and T-fitting 20. Dielectric unions and coupling devices such as coupling devices 14, 28 and 70 are utilized for connection of the hot water circuit to the bungs of the hot water heaters as well as for connection of the overall hot water connection circuit into the water circuitry path of a building, for example, which would rely upon the hot water being drawn from the water heaters. Additionally, ells such as elbows 15, 18, 23 and 27 are utilized within the hot water connection circuit to effectively connect the water directing conduit in a liquid tight environment while at the same time changing the direction of the path so as to be capable of isolating the otherwise exposed hot water conduit so as to preclude the inadvertent burning of hands, arms, etc. of a proximate person. As can be seen in FIG. 2, the hot water connection circuit emanates in a substantially vertical direction upwardly from the tops of the respective hot water heaters to a very short distance, at which time both paths 31 and 31*a* assume a horizontal disposition toward the rear of the exposed water heaters. The circuitry remains in the horizontal configuration as both paths 31 and 31*a* return to meet in the opposite ends of T-shaped fitting 20 for subsequent vertical transmission through circuit output device 21. Valving means such as valves 52 and 53 are interposed into each of the hot water output heater paths 31 and 31*a*, respectively, so as to be able to stop the flow of water, as desired, for the purpose of servicing either of the heaters.

Figure 3:
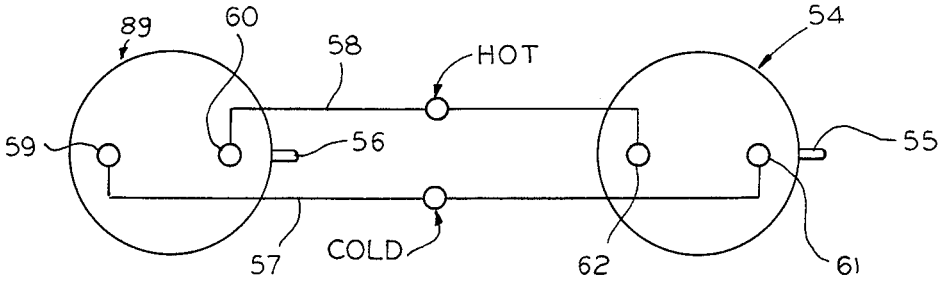
FIG. 3 is a top planar schematic illustration showing particularly the positions of the hot and cold water connection circuitry as applied to the two tandem water heaters as well as showing the positions of the hot water bungs and cold water bungs necessary for installation of the apparatus.

In like fashion, the cold water connection means, also shown in FIG. 2, serves to connect cold water bungs 34 and 47 emanating from the top of the tandem hot water heaters. Due to the repositioning of the hot and cold bungs and their associated tubing which is internal to the hot water heaters, hot water bungs 30 and 29 are placed at the closest possible distance from one another, as shown in FIG. 3, while cold water bungs 34 and 47 are pre-positioned at a substantially greater distance apart. Cold water connection circuit 88 is shown comprising equidistant cold water heater input paths 32 and 32*a*. As in the hot water connection circuit 13, the cold water connection circuit 88 relies upon the integration of a series of dielectric unions, T-fittings, valves and 90° ells together with straight conduit so as to function in a substantially watertight environment. In contrast to the isolated rearward configuration of the hot water connection circuit 13, the cold water connection circuit 88 emanates initially upwardly in a vertical direction from cold water bungs 34 and 47 to a short height at which time paths 32 and 32*a* are disposed in a horizontal plane in a direction forward toward the front exposed surfaces of the tandem water heaters. Indeed, cold water connection circuit 88 relies upon ells 35, 38, 44 and 45 to accommodate the change from the vertical direction to the horizontal position where circuit segments 39 and 43 ultimately draw inwardly to meet T-fitting 40 and, in turn, the vertically oriented cold water input circuit fitting 41 comprising the single source through which cold water is initially directed to both of the tandem water heaters. Dielectric unions and coupling devices such as couplers 33, 46 and 71, serve to connect the apparatus into the respective cold water input bungs for the water heaters and flow stoppage means 50 and 51 are interposed into each of the cold water heater input paths to similarly permit facilitated servicing of the water heaters. Cold water input heater paths 32 and 32*a* are preferably fabricated in equal lengths of equal cross sectionaal elements to assist in the balanced flow of cold water from T-fitting 40 to bung 47 and from T-fitting 40 to bung 34. Through the use of such a "low-profile" construction, installation of the overall apparatus is facilitated and interference with flues and the like is minimized. Additionally, the low-profile construction of the present apparatus cooperates with the rearwardly positioned hot water connection circuit to further preclude inadvertent burns while at the same time imposing the cold water connection means as a "guardrail" to further preclude the inadvertent touching of the hot water pipes.

The equal centering of the circuit components 41 and 21 with equal size path conduits, besides guaranteeing the natural balanced flow of water into and out of the tandemly connectly hot water heaters, serves to further prompt the equal feed and draw from heaters of like kind and size resulting in a minimal differential in heating element "turn-on" rates of from only 15 to 20 seconds, while serving to more appropriately distribute the water heating requirements equally between the two tandem heaters so as to minimize unequal wear between them.

The top planar schematic of FIG. 3 shows schematically, the top portions of the two tandem water heaters and cold water bungs 59 and 61 as well as hot water bungs 60 and 62, respectively. The equidistant positioning of the hot and cold water single circuit elements, "HOT and COLD", is also shown as are conventional relief valves 55 and 56 in hot water heaters 54 and 89.

The present invention further includes a method for integrally joining these two conventional water heaters. This method comprises the steps of pre-positioning the hot water bungs such as shown in FIG. 3 so that hot water bungs 60 and 62 are most closely adjacent to one another and cold water bungs 59 and 61 are more distant. The operation includes the connection of equally sized hot water output conduits to each of the hot water bungs such as hot water output conduits 31 and 31*a* with each intitially rising upwardly in a vertical direction from the heaters then rearwardly from the exposed fronts of the heaters and inwardly toward one another for operable connection in the opposite ends of T-fitting 20. Equally sized cold water input conduits 32 and 32*a* are connected to the cold water bungs such as bungs 59 and 61 (34 and 47) to rise initially upwardly from the bungs, then forwardly toward the exposed fronts of the heaters and inwardly toward one another for operable connection into the cold water circuit fitting, T-fitting 40. Valving means are positioned within each of the hot water output conduits and the cold water input conduits.

Preferably this method of connecting the hot water heaters in parallel includes the prefabrication of the hot and cold water connection systems in which the conduit tubing is pre-cut into desired equidistant lengths and are integrated through dielectric unions, such as couplers 33 and 46, 90° ells, such as ells 38 and 44, T-fittings such as T-fittings 40 and 20, and valves such as valves 51 and 50 so as to form the respective conduit paths. All these components are fluxed and sweated into the respective conduit paths and are burnished prior to the pressure testing of the conduit paths so as to make capable the subsequent integrated installation of the entire prefabricated conduit system onto the hot and cold water bungs.

The foregoing description and drawings merely explain and illustrate the invention and the invention is not limited thereto, except insofar as the appended claims are so limited, as those skilled in the art who have the disclosure before them will be able to make modifications and variations therein without departing from the scope of the invention.

For example, it is contemplated so as to be within the scope of the invention to connect more than two water heaters through the present apparatus such as through the utilization of two such devices to initially connect two pairs of heaters, which would then be integrated together by a third such apparatus, so as to ultimately connect four water heaters.

What is claimed is:

1. A modular water heater connection apparatus for integrally joining the cold water input and hot water output bungs respectively of a plurality of conventional water heaters arranged in tandem, said apparatus comprising:

low-profile cold water connection means including single cold water circuit input means for directing substantially cold water from a single input source to said apparatus and a plurality of cold water heater input means operably connected at their first ends to said cold water circuit input means for diverting cold water from said circuit input means to each of the cold water input bungs possessed by each of said tandem water heaters respectively;

each of said cold water heater input means operably connected at their second ends to each of said respective cold water input bungs;

low-profile hot water connection means including a single hot water circuit output means for directing water heated by each of said water heaters to a single output destination and a plurality of hot water heater output means operably connected at their first ends to said hot water circuit output means and at their second ends to each of said respective hot water output bungs to transfer said heated water from each of said water heaters to said single output destination;

one or more of said cold water connection means and hot water connection means including flow stoppage means for closing off the flow of water therethrough for purposes of servicing one or more of said plurality of heaters;

said low-profile cold and hot water connection means being connected to said respective bungs by bung connection means, and to said respective circuit input and output means by circuit attachment means;

said apparatus further including hot water segregation means for isolating the entire position of said hot water connection means to preclude inadvertent contact therewith;

water flow balancing means for equalizing the flow of cold water into and hot water out of each of said tandem water heaters;

said water flow balancing means including said cold water circuit input means being equidistantly positioned between each of said plurality of cold water heater input means; and said hot water circuit output means being equidistantly positioned between each of said plurality of hot water heater output means; and said equidistant positioning of said cold and hot water circuit input and output means serving to equalize and balance flow through each of said heater input and output means respectively.

2. The invention according to claim 1 in which each of said low-profile cold and hot water connection means comprises a water flow conduit arrangement emanating vertically a substantially short distance from said water heater thereafter bending to a position substantially horizontal in nature:

each of said plurality of cold water heater input means and hot water output means comprising a portion of said water flow conduit emanating from said respective bungs in a substantially vertical position and assuming respective shapes substantially horizontal and parallel to the top planar surfaces of said water heaters;

said cold water circuit input means and hot water circuit output means rising substantially vertically from respective ones of said substantially horizontally positioned heater input and heater output means.

3. The invention according to claim 2 in which plurality of cold water heater input means comprises two heater input conduits joined to said circuit input means by a T-shaped input coupling member:

said plurality of hot water heater output means comprising two heater output conduits joined to said circuit output means by a T-shaped output coupling member.

4. The invention according to claim 1 in which said flow stoppage means comprises valving members:

at least one of said valving members being operably connected into each of said plurality of cold water heater input means;

at least one said valving members being operably connected into each of said plurality of hot water heater output means; and each of said flow stoppage means capable of stopping the flow through said respective input and output means for the purpose of facilitating the servicing of one or more of said tandem water heaters.

5. The invention according to claim 2 in which the positions of said hot water bungs and the hot water heater tubing associated therewith are pre-positioned along the immediately adjacentmost edges of said tandem water heaters:

said respective hot water bungs thus assuming positions substantially closer to one another than the distance between the positions of said respective cold water bungs on each of said water heaters.

6. A modular water heater connection apparatus for integrally joining the cold water input and hot water output bungs respectively of a plurality of conventional water heaters arranged in tandem, said apparatus comprising:

low profile cold water connection means including single cold water circuit input means for directing substantially cold water from a single input source to said apparatus and a plurality of cold water heater input means operably connected at their first ends to said cold water circuit input means for diverting cold water from said circuit input means to each of the cold water input bungs possessed by each of said tandem water heater respectively;

each of said cold water heater input means operably connected at their second ends to each of said respective cold water input bungs;

low-profile hot water connection means including a single hot water circuit output means for directing water heated by each of said water heaters to a single output destination and a plurality of hot water heater output means operably connected at their first ends to said hot water circuit output means and at their second ends to each of said respective hot water output bungs to transfer said heated water from each of said water heaters to said single output destination;

one or more of said cold water connection means and hot water connection means including flow stoppage means for closing off the flow of water therethrough for purposes of servicing one or more of said plurality of heaters;

said low-profile cold and hot water connection means being connected to said respective bungs by bung connection means, and to said respective circuit input and output means by circuit attachment means;

each of said low-profile cold and hot water connection means comprising a water flow conduit arrangement emanating vertically a substantially short distance from said water heater thereafter bending to a position substantially horizontal in nature;

each of said plurality of cold water heater input means and hot water output means comprising a portion of said water flow conduit emanating from said respective bungs in a substantially vertical position and assuming respective shapes substantially horizontal and parallel to the top planar surfaces of said water heaters;

said cold water circuit input means and hot water circuit output means rising substantially vertically from respective ones of said substantially horizontally positioned heater input and heater output means;

the positions of said hot water bungs and the hot water heater tubing associated therewith being positioned along the immediately adjacentmost edges of said tandem water heaters with said respective hot water bungs assuming positions substantially closer to one another than the distance between the positions of said respective cold water bungs on each of said water heaters;

said apparatus further including hot water segregation means for isolating the entire position of said hot water connection means to preclude inadvertent contact therewith;

said hot water segregation means for isolating said position of said hot water connection means comprising said closely positioned hot water bungs being operably connected to said hot water heater output means in said initial substantially vertical position;

said heater output means assuming said substantially horizontal position in a direction rearwardly from the exposed fronts of said tandem water heaters and being bent inwardly toward one another to operably meet and connect into respective ends of said hot water circuit output means;

said cold water input means initially assuming said initial short, vertical configuration and assuming said substantially horizontal positions in a direction forwardly toward the exposed fronts of said tandem water heaters being bent inwardly toward one another to operably meet and connect into respective ends of said cold water circuit input means;

said cold water connection means further serving as a guardrail to further preclude inadvertent contact with said rearwardly positioned isolated hot water connection means; and water flow balancing means for equalizing the flow of cold water into and hot water out of each of said tandem water heaters.

* * * * *

UNITED STATES PATENT AND TRADEMARK OFFICE

CERTIFICATE OF CORRECTION

PATENT NO. : 4,550,710

DATED : November 5, 1985

INVENTOR(S) : McDonald II

It is certified that error appears in the above-identified patent and that said Letters Patent is hereby corrected as shown below:

| | |
|---|---|
| Col. 1, line 26 | "interconnection" should be instead -- interconnections -- |
| Col. 1, line 32 | "intereference" should be instead -- interference -- |
| Col. 1, line 38 | "heater" should be instead -- heating -- |
| Col. 3, line 22 | "directionn" should be instead -- direction -- |
| Col. 3, line 46 | "the" should be instead -- and -- |
| Col. 4, line 43 | "formms" should be instead -- forms -- |
| Col. 4, line 54 | "intial" should be instead -- initial -- |

UNITED STATES PATENT AND TRADEMARK OFFICE

CERTIFICATE OF CORRECTION

PATENT NO. : 4,550,710

DATED : November 5, 1985

INVENTOR(S) : McDonald II

It is certified that error appears in the above-identified patent and that said Letters Patent is hereby corrected as shown below:

| | |
|---|---|
| Col. 4, line 62 | "watter" should be instead -- water -- |
| Col. 8, line 28 | -- said -- should be inserted after "which" |
| Col. 9, line 2 | "heater" should be instead -- heaters -- |

Signed and Sealed this

*Twenty-sixth* Day of *August 1986*

[SEAL]

*Attest:*

DONALD J. QUIGG

*Attesting Officer*

*Commissioner of Patents and Trademarks*